US010410611B2

(12) United States Patent
Calder

(10) Patent No.: US 10,410,611 B2
(45) Date of Patent: Sep. 10, 2019

(54) GUITAR PLAYING ACCESSORY

(71) Applicant: Michael Alexander Calder, San Francisco, CA (US)

(72) Inventor: Michael Alexander Calder, San Francisco, CA (US)

( * ) Notice: Subject to any disclaimer, the term of this patent is extended or adjusted under 35 U.S.C. 154(b) by 0 days.

(21) Appl. No.: 15/111,123

(22) PCT Filed: Jan. 12, 2015

(86) PCT No.: PCT/US2015/000003
§ 371 (c)(1),
(2) Date: Oct. 19, 2016

(87) PCT Pub. No.: WO2015/105726
PCT Pub. Date: Jul. 16, 2015

(65) Prior Publication Data

US 2017/0178606 A1 Jun. 22, 2017

Related U.S. Application Data

(60) Provisional application No. 61/926,326, filed on Jan. 12, 2014.

(51) Int. Cl.

| | |
|---|---|
| ***G10D 3/16*** | (2006.01) |
| ***G10H 3/18*** | (2006.01) |
| ***G10D 1/08*** | (2006.01) |
| ***G10D 3/00*** | (2006.01) |

(52) U.S. Cl.
CPC ..... *G10D 3/163* (2013.01); *G10D 1/085* (2013.01); *G10D 3/00* (2013.01); *G10H 3/18* (2013.01)

(58) Field of Classification Search
CPC ..... G10D 3/08; G10D 3/163
See application file for complete search history.

(56) References Cited

U.S. PATENT DOCUMENTS

| | | | | |
|---|---|---|---|---|
| 5,488,891 | A * | 2/1996 | Baker | G10D 3/00 84/319 |
| 2014/0076120 | A1* | 3/2014 | Hollin, Jr. | G10D 3/163 84/322 |
| 2015/0348517 | A1* | 12/2015 | Shamchuk | G10D 1/08 84/329 |

* cited by examiner

*Primary Examiner* — Kimberly R Lockett
(74) *Attorney, Agent, or Firm* — Owen J. Bates

(57) ABSTRACT

A system consisting of one or more components that enables the playing of a stringed instrument by contacting one or more strings of the instrument in such a manner as to cause the frequency emitted to change when the string is mechanically agitated so as to vibrate.

7 Claims, 7 Drawing Sheets

GUITAR PLAYING ACCESSORY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

BACKGROUND OF THE INVENTION (1) Field of the Invention

The present invention relates to a manual accessory which provides a guitar player with significantly enhanced techniques, dramatically increased playing options, ease of playing, as well as new techniques of playing that were previously unavailable. The present invention is a significant enhancement of existing slides as presently being used, thereby advancing a player's musical vocabulary, affording new techniques, novel sounds, and new stylistic playing options. The present invention is worn like a ring on one finger of the hand and provides the capabilities to play utilizing both slide techniques and fretting techniques simultaneously. Though the present invention is described herein as being used with a guitar, it should be understood that aspects of the present invention can be used with most stringed instruments.

(2) Brief Summary of the Invention

The present invention consists of a two-component system for enhancing the art of playing a stringed instrument. Either of the two components can be used alone. However using both components at the same time provides a greater enhancement in quality of the sound and the ability to utilize playing techniques that were previously unavailable.

The first component is a magnetizing element that is placed in proximity to the strings and placed just beyond the nut of the guitar. By being placed near to or in actual contact with the strings, the magnetizing element will impart a magnetic field to the steel strings of the guitar. The classical guitar is often times fitted with nylon strings. Thus this component of the present invention is primarily intended for use with an electric guitar which typically uses steel strings.

If just the magnetizing component is used, then there will be enhanced quality to the audio that is produced by the electric guitar because the strings have a stronger magnetic field about each one and therefore there will be an enhanced signal generated by the pickup as the string vibrates over it.

The second component is a frequency selecting element which is held by the hand and is placed in contact with one or more of the strings of the instrument. The frequency selecting element includes one or more magnets. As the frequency selecting element is placed in contact with one or more of the strings, the length of the string that will vibrate when the string is plucked changes and the frequency of the sound that is produced also changes. The terms frequency selecting element and magnetic slide are used herein interchangeably.

Another unique feature of the present invention is that a player can use his fingers to fret the strings of the guitar while at the same time using the magnetic slide to play slide notes. An extensive list of the playing techniques that are enabled by the present invention is provided below.

BRIEF DESCRIPTION OF THE SEVERAL VIEWS OF THE DRAWINGS

Whereas the present invention has been described herein with respect to specific embodiments thereof, it will be understood that various changes and modifications will be suggested to one skilled in the art and it is intended that the invention encompass such changes and modifications as falling within the scope of the appended claims. Reference will now be Made to the accompanying drawings, which are not necessarily drawn to scale; and wherein:

BACKGROUND

Figure 1:
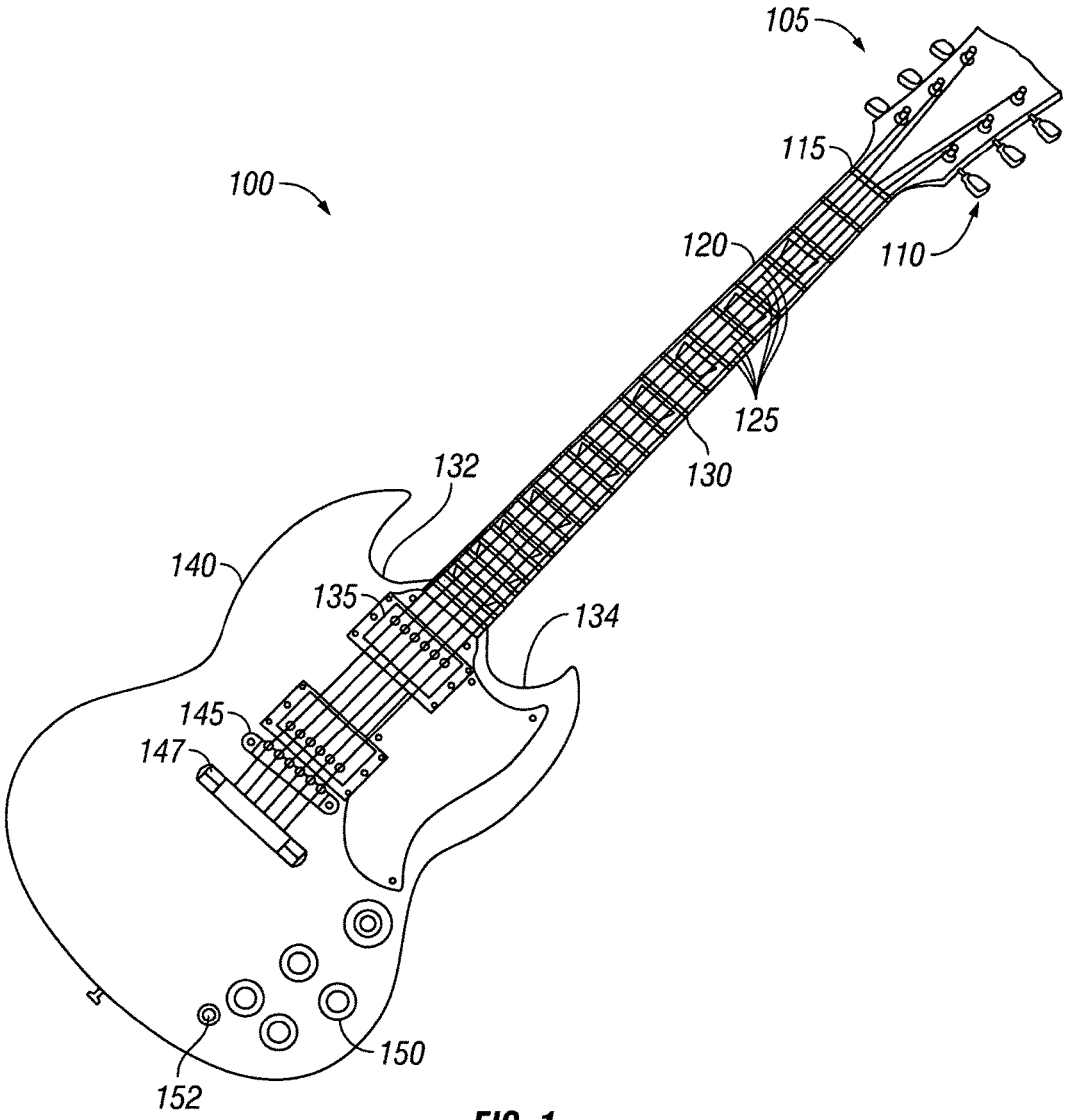
FIG. 1 shows a typical electric guitar of the prior art.

FIG. 1 shows the typical components of an Electric Guitar 100. At one end of Electric Guitar 100 is Headstock 105 which includes a plurality of Tuning Pegs 110. At the other end of Electric Guitar 100 is Body 140. Connecting the Body 140 and Headstock 105 is Neck 120. Strings 125 are attached to the Body 140 at Tailpiece 147. The Strings 125 then pass over Bridge 145 which supports the strings above the body and also properly spaces the Strings 125 across the surface of Neck 120. One or more Magnetic Pickups 135 are attached to the upper portion of the Body 140 directly underneath the Strings 125. The Pickups 145 can detect the vibration of the strings and generate an electrical signal. An amplifier (not shown) can be connected to the Electric Guitar by way of Output Jack 152.

The Strings 125 extend up the upper surface of Neck 120 and passes over Nut 115 which also supports and spaces the strings. The Strings 125 are attached to Tuning Peg 110 by various means known in the art. The tension on each of Strings 125 can be adjusted by turning the Tuning Pegs 110 to increase the tension and thus adjust and tune the note produced by each string.

Figure 2:
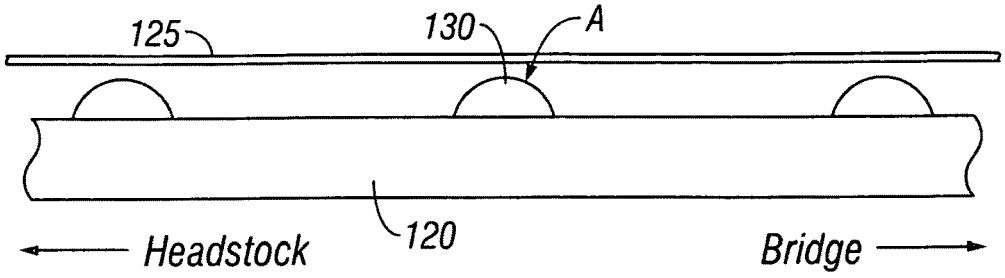
FIG. 2 shows a diagrammatic side view of the neck of an electric guitar of the prior art.

FIG. 2 shows a diagrammatic side view of a guitar Neck 120 showing one String 125 of any possible number of strings positioned on the Neck 120 of a guitar. String 125 is typically positioned so that it is positioned a small distance over each of the Frets 130 as shown at Location A in FIG. 2. The Headstock 105 of the guitar is to the left and the Bridge 145 of the guitar is to the right in FIGS. 2-7. A typical Neck 120 will have 19-22 Frets 130 along its length. Each String 125 is tuned to a specific note that the String 125 will produce when it is plucked (open-string note).

Figure 3:
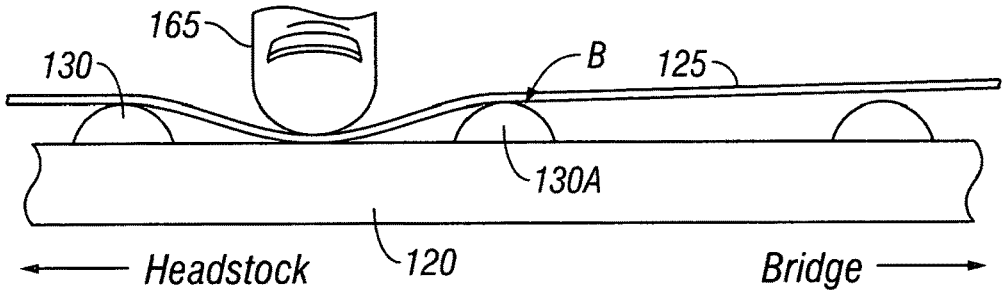
FIG. 3 shows a diagrammatic side view of a guitar string being fretted which is a technique of the prior art.

Higher notes can be generated from String 125 by depressing the string with Finger 165 so that the String 125 dampened at the location of the Fret 130A—shown at position Bin FIG. 3. Thus the vibration length of the string is now shortened and the vibration length is the distance from Fret 130A to the Bridge 145. The shorter the vibration length of the string, the higher the note that is produced when the string is plucked between the Fret 130A and Bridge 145. The standard method of playing the guitar limits each string to fixed number of notes. There is one for the open-string note and one note for each of the available Frets 130.

Figure 4:
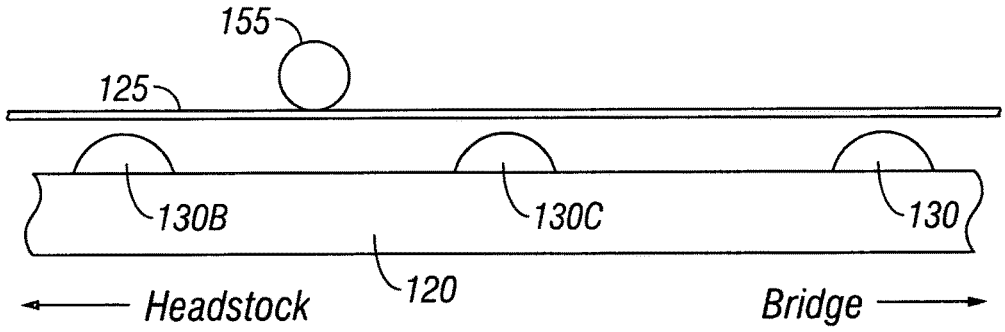
FIG. 4 shows a diagrammatic side view of guitar slide being positioned above a guitar string which is a technique of the prior art.

An alternative method of playing utilizes a slide which is typically a tube or rod made of various materials and placed around or alongside one finger of one hand (typically the ring or little finger of the left hand). The slide is placed in contact with one or more strings without depressing the string to such an extent that the string is pressed against one of the frets. FIG. 4 shows the use of a slide with a standard guitar. Slide 155 is shown placed in contact with the String 125. Thus the vibration length of String 125 is from the point of contact of Slide 155 with String 125 to the Bridge 145. The note that is produced when String 125 is plucked will be between the notes that would have been produced if String 125 had been fretted against Fret 130B and Fret 130C.

Another technique that is enabled by the use of a slide is that Slide 155 can be moved along the length of the string while the string is vibrating causing a rapid and continuously variable change in the frequency of the note generated, a technique referred to as vibrato.

One of the difficulties that arise when using this technique is that Slide 155 must be placed in contact with the string with just enough force to sufficiently dampen vibration at the point of contact, but not depress the String 125 with enough force that the String 125 is placed in contact with one of the Frets 130.

Figure 5:
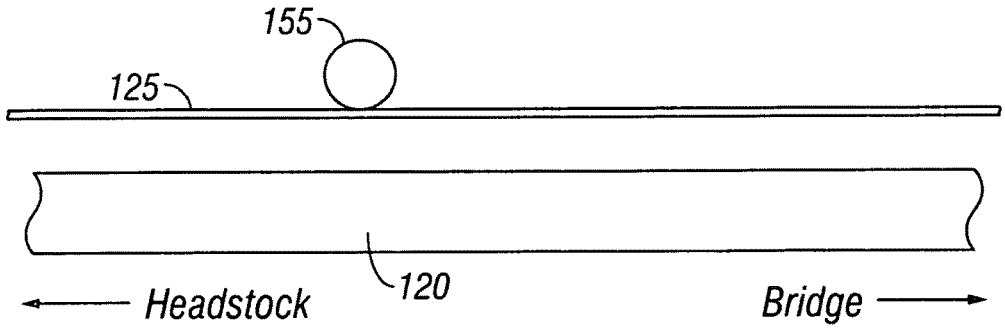
FIG. 5 shows a diagrammatic side view of slide being positioned on the neck of a fretless guitar as used in the prior art.
Figure 6:
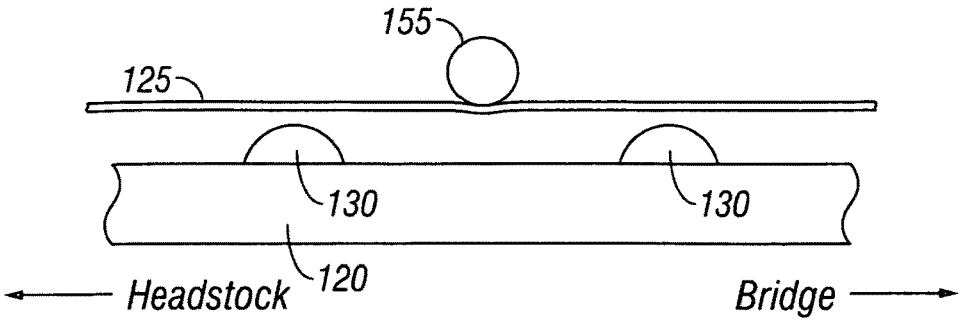
FIG. 6 shows a diagrammatic side view of a slide slightly depressing a string on a fretted guitar as used in the prior art.

One way this problem has been addressed is to utilize a modified guitar which has no Frets 130 on Neck 120. FIG. 5 shows such a modification. Even without the Frets 130, the Slide 155 must be placed in contact with String 125 with a small amount of force, as shown in FIG. 6, so that there is no buzzing, and a clean note is produced.

DETAILED DESCRIPTION OF THE INVENTION

A key element of the present invention is the use a slide having a bar made out of magnetic material instead of the usual non-magnetic material. Slides used in the prior art, have been made of ceramic, brass, stainless steel, aluminum, copper tubing, pvc tubing, glass medicine bottles, necks cut from glass bottles and even deep-well sockets from ratchet tool kits.

Figure 7:
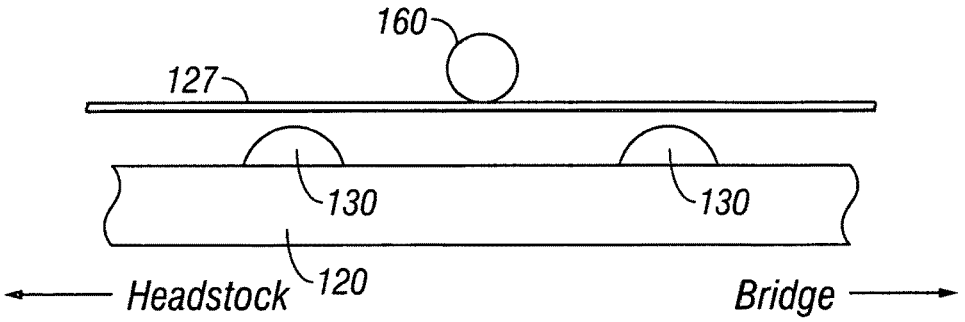
FIG. 7 shows a diagrammatic side view of an embodiment of the present invention which discloses the magnetic slide in contact with a guitar string.

FIG. 7 shows a graphic representation of a Magnetic Slide 160 in contact with Steel String 127, which will be attracted to the Magnetic Slide 160. Because of this attraction, Magnetic Slide 160 does not have to be pressed as hard against the Steel String 127 in order to dampen the vibration at the point of contact. Thus it is easier to move Magnetic Slide 160 along the length of the Steel String 127 and the chance of accidently fretting String 127 is much reduced.

Figure 8:
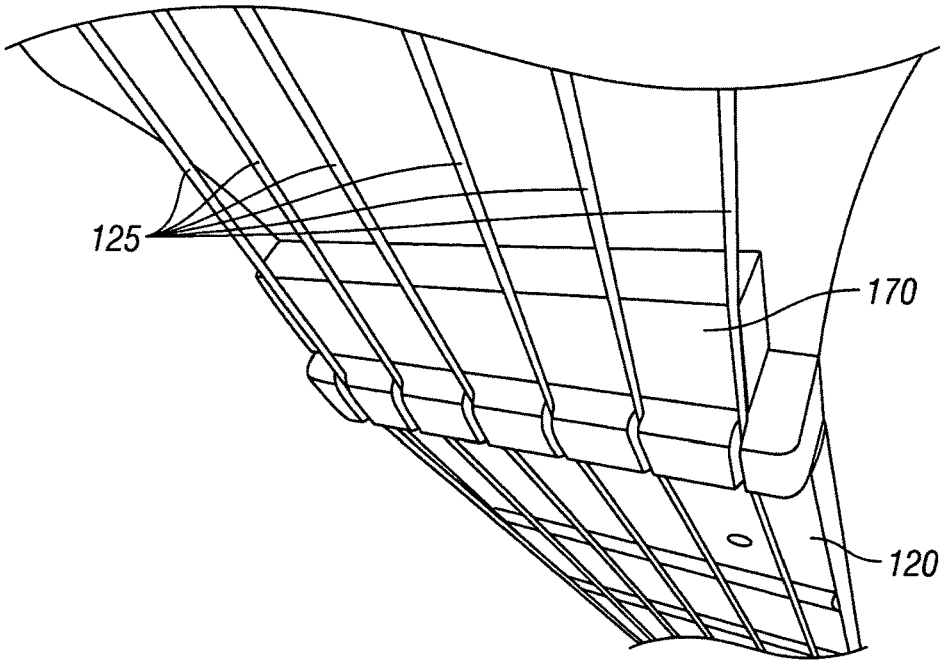
FIG. 8 shows a magnetic enhancement bar which is an optional component of the present invention.
Figure 9:
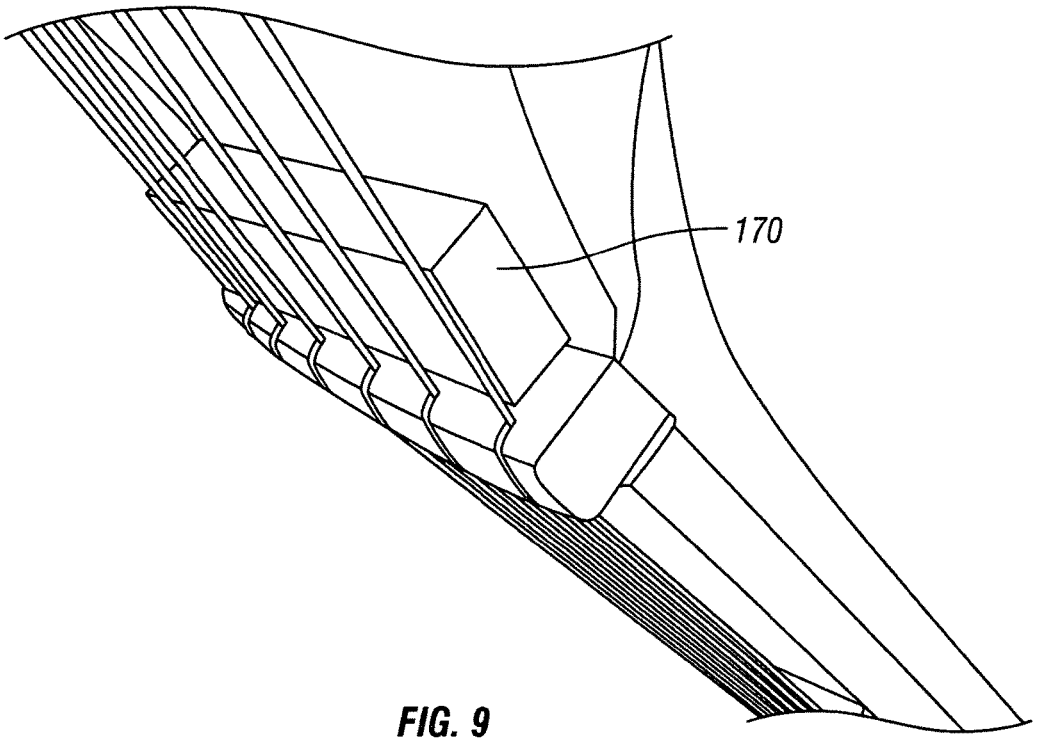
FIG. 9 shows an alternative view of FIG. 8.

FIGS. 8 and 9 show an optional component of the present invention. Magnetic Enhancer 170 is a magnet place under the strings of the guitar, behind the Nut 115. The Magnetic Enhancer 170 is generally sized so that the Magnetic Enhancer 170 is in contact with the strings. Sizing the Magnetic Enhancer 170 so that it touches, or remains close to the strings, is preferred. The Magnetic Enhancer 170 can be sized to be close but not touching the strings. The Magnetic Enhancer 170 will impart a stronger magnetic field to the strings which results in two benefits. The first is that there is an increased attraction between String 127 and the Magnetic Slide 160. The second, the increased magnetic field imparted to the String 127 causes the Magnetic Pickup 135 to generate a stronger signal, and increased note sustain, considered essential for optimal slide playing.

Figure 10:
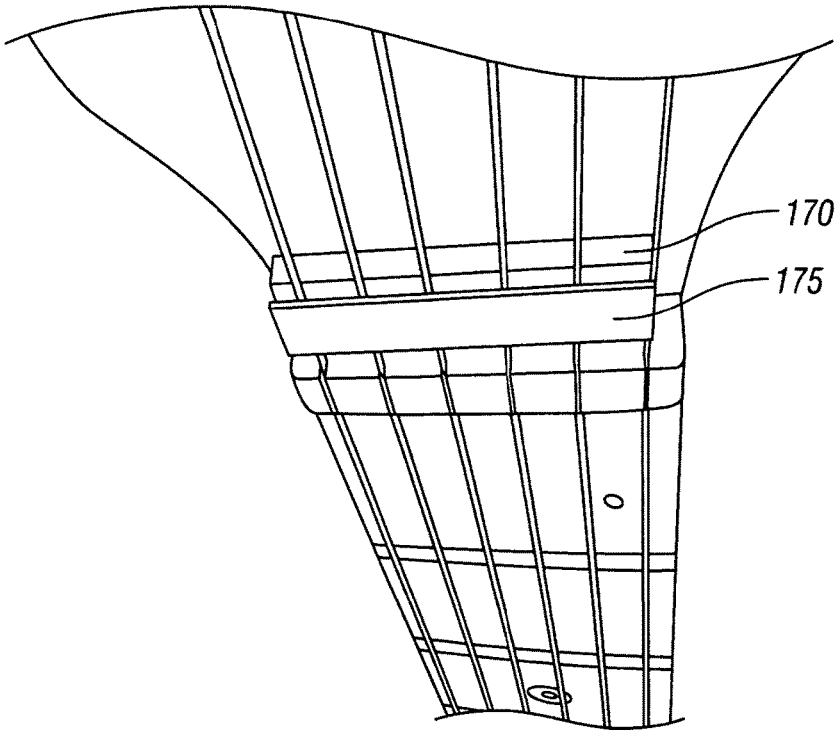
FIG. 10 shows a cap for the magnetic enhancement bar shown in FIGS. 8 and 9 which is an optional component of one embodiment of the present invention.

Shown in FIG. 10 is an optional Cap 175 which is placed above strings and aligned with Magnetic Enhancer 170. The Cap 175 helps stabilize the Magnetic Enhancer 170 and to ensure that is doesn't become dislodged during vigorous playing. Cap 175 may or may not be magnetic itself.

Cap 175 is preferably sized to have the same length and width as Magnetic Enhancer 170. Optionally, one or both of Magnetic Enhancer 170 and Cap 175 can be grooved on the two surfaces which face each other. The spacing and size of the grooves would match the spacing and size of the Strings 127. This would enable Magnetic Enhancer 170 and Cap 175 to be in direct or almost direct contact. This would impart a greater magnetic field to the strings and provide a more stable assembly of the two components.

Figure 11:
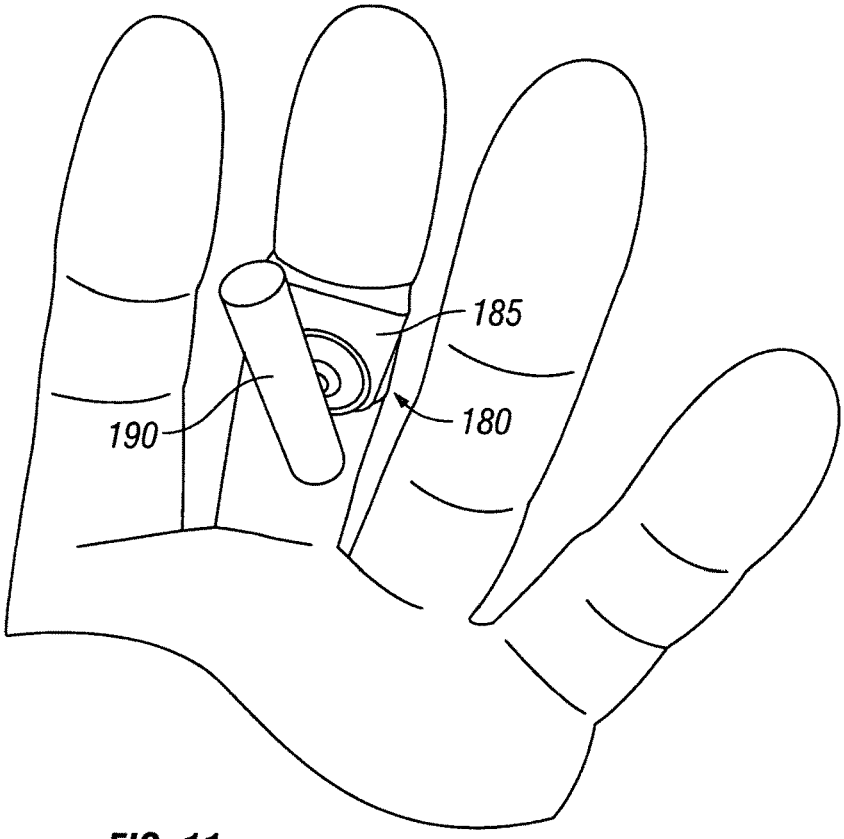
FIG. 11 shows a magnetic slide ring which is one embodiment of the present invention.
Figure 12:
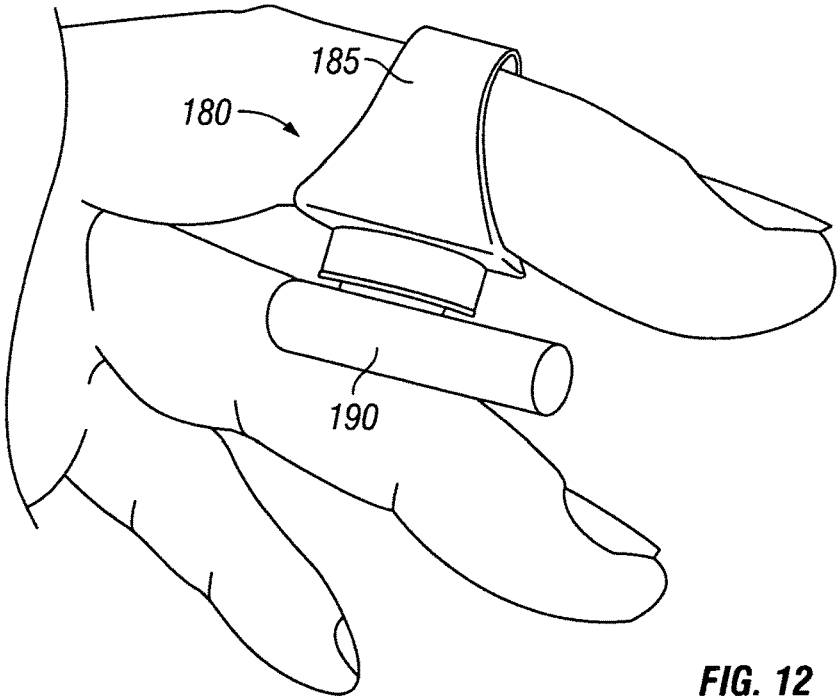
FIG. 12 shows an alternative view of a magnetic slide ring as shown in FIG. 11.

FIG. 11 shows one embodiment of Magnetic Slide 160 of the present invention. Single Finger Slide 180 is shown being worn on the finger of guitar player. Ring 185 is slipped onto the finger. Attached to one side of the Ring 185 is the Magnetic Bar 190. The positioning as shown in FIG. 11 allows the player full use of his fingers in order to fret the Strings 127. Magnetic Bar 190 is oriented slightly non-parallel with fingers. This enables maximum flexibility of the fingers to fret the strings as one would do in standard guitar playing techniques. FIG. 12 is another view of the same embodiment shown in FIG. 14.

Figure 13:
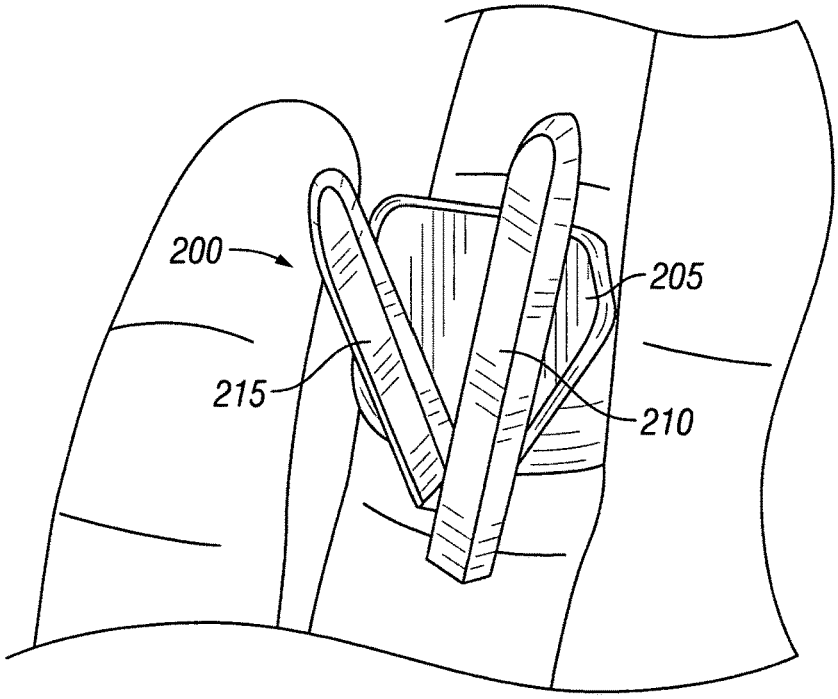
FIG. 13 shows a double slide ring which is one embodiment of the present invention.

FIG. 13 shows yet another embodiment of the present invention. Double Finger Slide 200 is shown positioned on the ring finger. In this embodiment there are two magnetic elements—First Magnetic Bar 210 and Second Magnetic Bar 215. Note that First and Second Magnetic Bars 210 and 215 are positioned about 30 degrees apart. This positioning of the First and Second Magnetic Bars 210 and 215 allows for access by the fingers of the player to fret the strings as well as play slide notes.

Figure 14:
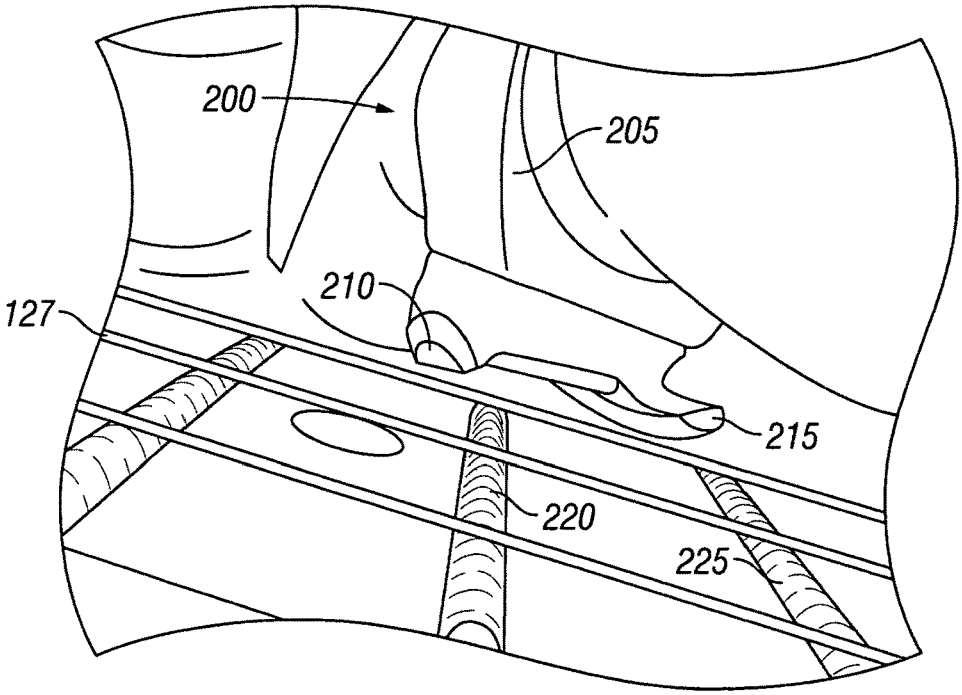
FIG. 14 shows a double slide ring which is one embodiment of the present invention positioned above and between the frets of a fretted guitar.

FIG. 14 shows Double Finger Slide 200 positioned over the strings of a fretted guitar. Note that First and Second Magnetic Slides 210 and 215 are positioned over two different fret spaces. With a slight rotation of the hand it is possible to play four notes. The first note can be played by bringing First Magnetic Slide 210 into contact with the String 127. Then First Magnetic Bar 210 is pressed harder against the String 127 so that it is fretted against Fret 220 which results in a second note. Then Double Finger Slide 200 is rotated in the opposite direction so that Second Magnetic Bar 215 is in contact with String 127 for the third note. Then Double Finger Slide 200 is rotated farther, pressing String 127 so that it is fretted against Fret 225 which produces the fourth note.

Figure 15:
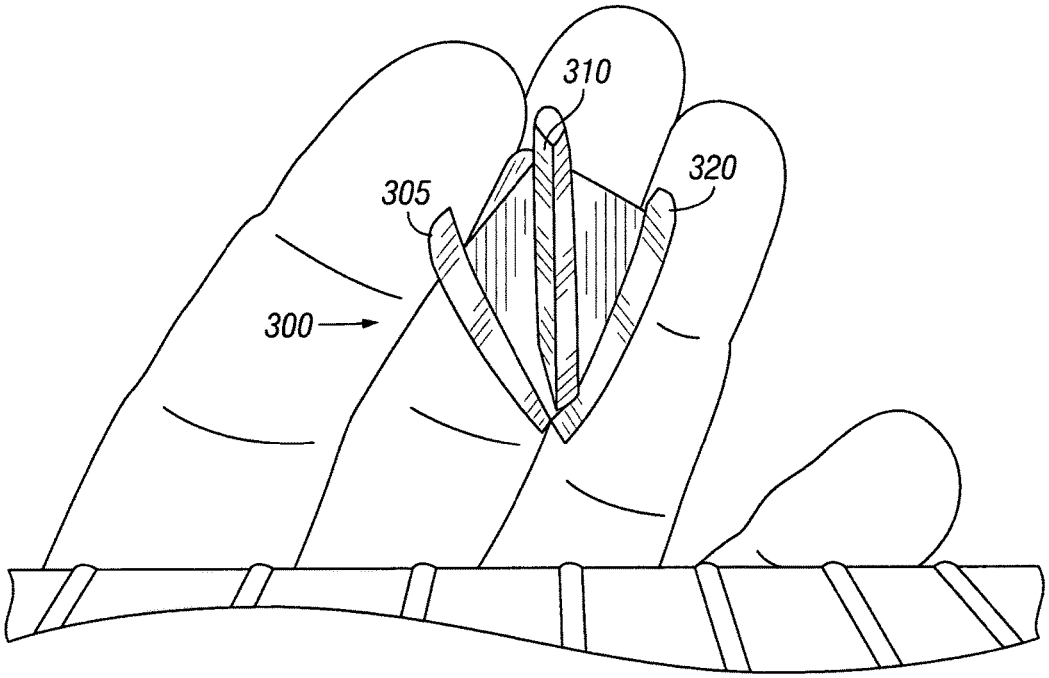
FIG. 15 shows a triple ring magnetic slide which is one embodiment of the present invention.
Figure 16:
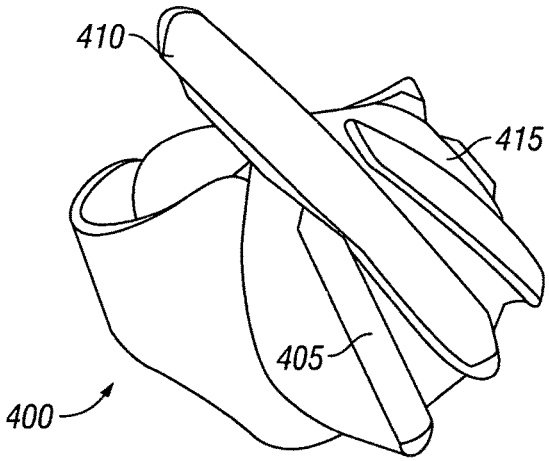
FIG. 16 shows an alternative triple ring magnetic slide which is one embodiment of the present invention.

FIG. 15 shows another embodiment of the present invention. Triple Finger Slide 300 is composed of three magnetic elements. These are Short Magnetic Bar 305, Long Magnetic Bar 310 and a second Short Magnetic Bar 320. By having three magnetic elements on the Triple Finger Slide 300, there are a number of increased capabilities in playing the guitar.

The Magnetic Bar of the Magnetic slide can be mechanically attached in any manner known in the art, which allows the angle of the Magnetic Bar in relation to the fingers to be adjustable to accommodate differences in hand size and shape between players and also to accommodate additional modes of play.

In a similar manner, one or more of the Magnetic Bar can be removably attached from the Magnetic Slide so that Magnetic Bars of various sizes and shapes can be attached to the Magnetic Slide. Such sizes and shapes could include but not be limited to cylindrical bars, square bars, rectangular bars, flat or beveled bars, curved bars, and coin-shaped.

Though described herein with one Magnetic Slide placed on a hand, it is within the scope of the invention that more than one Magnetic Slide could be placed on multiple fingers of the same hand.

Though optimal guitar playing is achieved by the use of the optional Magnetic Enhancer and a Magnetic Slide with the Magnetic Bar, it is within the scope of the invention to utilize a non-magnetic version of any of the embodiments described herein. Though the non-magnetic embodiments of the present invention would lack many of the benefits of the magnetic version, there would still be significant enhancements over the existing art because a player could utilize both slide and fret playing techniques at the same time without the need to reposition, remove and/or rotate the slide of the present invention.

Though the Magnetic Slide has been described herein as being worn similar to a ring, any physical configuration which allows a player to place one or more of the Magnetic Slides in contact with one or more strings is within scope of the present invention. This includes gripping by the fingers or attaching to any appendage of the human body such as might be used by an amputee or other physically disabled person.

Advantages of the Present Invention Over Existing Techniques for Playing a Guitar or Other Stringed Instrument 1. No Adjustments for Individual Strings (Normally a Huge Learning Curve).

When using a standard slide to play guitar, the pressure required to play a clean, sustained note for each string must continually be adjusted and readjusted perfectly by the player while playing, with each string requiring a different amount of correct pressure. Thinner strings require less pressure, and the exact pressure for each string must be compensated for at all times in order to produce a smooth even note without buzzing (too little pressure), muting (uneven pressure application or premature release), or "fretting out" (too much pressure when the slide is placed just above or too near a fret, resulting in an unpleasant metallic clanking sound when playing slide on a fretted instrument).

Present Invention: Since the magnet grabs each string differentially (thicker strings proportionally more than thinner) the pressure required for each string is automatically compensated and correctly adjusted by the invention Therefore all strings produce clean sustained notes using the same pressure—merely gently touching the strings. This makes for virtually no learning curve, and minimal difficulty in producing clean notes consistently and with minimal adjustment in techniques required while playing. Beginners can play slide correctly and cleanly the first time, without a concern for adjusting the pressure for each string, or learning how.

2. Signal Boost (Magnetic Advantage).

A sustained electronic output from the pickup is required to produce a classic slide note Which lingers past the moment it is plucked. Normally, this requires the player to make an adjustment either on the electronics in the guitar (temporary gain boost, volume increase, etc.), the effects pedal (boosting signal), or the amplifier (dual channel, foot switch).

Present Invention: The magnetic coupling between the strings and the pickups is enhanced because of the magnetic field applied to the strings by the Magnetic Enhancer and the optional Cap, thereby automatically boosting the signal. Furthermore, the Magnetic Bar attached to the Magnetic Slide also enhances the magnetic coupling. No adjustments are necessary to the amplifier, guitar settings or other electronic accessories in order to achieve this signal boost.

3. Self-Correcting Light Pressure on Strings.

Frequently guitarists will increase the gap distance between the frets and strings (the "action" or "relief") to allow a more forgiving playability while playing slide. However, this adjustment makes playing with fingers more difficult because more pressure must be applied to fret the strings when playing with fingers. Thus, for other than the most skilled guitarists, the instrument must be set up for either slide playing or fretted playing, and since these optimizations are in polar opposite directions, this makes the interchangeability with finger-playing and slide-playing difficult, or nearly impossible for most players.

Present Invention: However, because of the present invention, the same optimal adjustment of the action for finger-playing can be used for slide playing. Therefore, a player can seamlessly switch back-and-forth between the two techniques with optimal playing for both. This advantage is not available with slides of the prior art.

4: No Fretting Out or Buzzing (Self-Correcting).

Pressing too hard with a traditional slide causes unintended fretting out or buzzing Since use of the present invention requires almost no downward pressure (only a light touch is required because of the magnetic attraction between the steel string and the Magnetic Bar), it eliminates this common problem. This aspect in particular, makes this invention especially suited for students, since it makes the art especially easy to learn, instead of very difficult.

5. Self-Damping.

Damping: typical slide playing requires finger-damping. In order for the slide to be played cleanly (no unpleasant overtones caused by sympathetic string vibrations upstream of the slide that is between the headstock/nut and the slide) the upstream portion of the guitar strings must be muted with a finger. This is called "damping" and requires the full use of an additional finger in addition to and separate from the finger on which the slide is placed. This dampening finger is typically placed just touching across all played strings upstream from the location of the slide. Therefore the minimum number of fingers required is two and they can be used for nothing else while playing with a slide of the prior art.

6. Concealed and Non-Interfering.

The present invention is typically configured as a small ring, instead of a full or partial tube slide. It does not interfere with the full use of the player's fingers to fret strings while simultaneously using slide techniques.

7. Multiple Configurations: Single, Double, Triple-Slide, All Possible Versions.

The present invention can be utilized in various embodiments which have adjustable angles of the Magnetic Bar and multiple Magnetic Bars attached to each Magnetic Slide. This provides for many playing advantages including, articulation, speed, mobility, versatility, melodic notations, chord augmentations, all without transitional pauses, typical of prior art methods and designs, etc.

8. Ability to Simultaneously Use Same Finger on Which Slide is Mounted.

Normally, any finger used for slide placement cannot simultaneously be used for finger-pad (tip-of-finger) playing.

Present Invention: Because only the tip of a finger is needed for fretting a string, the tip of the finger that is wearing the present invention is unhindered for playing, and therefore the player has the ability to use that finger which he could not do if was using a typical slide. This has the effect of giving the player an extra finger (normally unavailable while wearing a slide) to simultaneously fret notes, play chords, pluck harmonics, mute, or any other standard techniques.

9. Automatic Self-Alignment with Playing Hand Position (Novel).

With traditional tube slides, it is required that the player align the slide perpendicular with the strings, which is not a natural playing angle for fingers. The present invention is angled to allow the Magnetic bar to be aligned perpendicular with the string while allowing the finger placed in a more angled position while playing.

10. Transitioning Instantaneously, Back and Forth Between Slide and Fingers (Novel).

Because the Magnetic Bar is positioned perpendicular to the strings and at the same time the fingers can be properly angled for fretting the strings, a player can easily, almost instantaneously, switch between using slide techniques and fretting techniques.

11. Sliding Chords: Simultaneous Sliding of Notes, Chords, and New Configurations.

The present invention allows all of the fingers of the slide-wearing hand to fret the strings which allows for the creation of unique effects such as sliding full chords, adjusting those chords mid-play, and adding trills, mini-bars, and additional note runs, all while playing slide, and without interfering with the slide function.

12. Trilling and Vibrato: Rapid, Simple Rocking Motion Replaces Normally Difficult Linear Slide-Action for These Effects.

Multi-magnetic bar embodiment of the present invention allow for extremely fast additional note articulations using minimal perceptible motion which allow for a broad range of new music possibilities previously unavailable. This extremely efficient and multi-note functionality is unavailable to traditional slide players.

13. Fretting Notes and Sliding Notes.

Just by slightly pressing the Magnetic Slide against the strings and then rocking the Magnetic Slide back and forth across the width of the neck, it is possible to create up to a dozen notes without moving the Magnetic Slide up or down the Neck. Especially with the multi-magnetic bar embodiments, each magnetic bar can function as a surrogate finger—meaning each slide can function as if it represented a separate finger, and since they are more closely spaced than fingers, the motion required to alternate string contact between each slide arm is much smaller, and can be executed much faster. Furthermore, each magnetic bar of a multi-magnetic bar model can be depressed to fret a note, creating the possibility of making fretted notes and slide notes alternately in rapid succession making fast playing of clean, articulated notes possible without the need for additional fingers beyond the one holding the slide.

14. Rapid Note Playing—Extreme Speed.

The present invention enables a rapid speed of playing, especially with rapid-articulation notes created by the controlled rocking of the double and triple Finger Slides: It utilizes only a slight rotation of the finger, independent of finger movement or use of fingertips. This creates a new degree of playing ease, efficiency, and speed, previously unattainable and entirely novel. Furthermore, each slide arm of a multi-slide model can be depressed to fret a note, creating the possibility of making fretted notes and slide notes alternately in rapid succession—making ultra-fast playing of clean, articulated notes possible without the need for additional fingers beyond the one holding the slide.

15. Playing Scales.

Normally, slide-players avoid rapid playing of specific notes since precision in placement of the slide is required. With the present invention, new scale speed and individual note articulations are accomplished with scales and notes in rapid, precise succession.

16. Novel Chords.

The present invention enables its magnetic bars to be used in place of a finger, thereby replacing fingers normally required for making specific chord shapes, and then making those replaced fingers available for other notes, which creates the possibility for new chords, which are unplayable without the present invention.

17. Ability to Play "Stream-of-Consciousness" Positional Playing.

Positional playing: since the relationship between notes can be determined by where the present invention is placed on the strings (instead of the position of a fret), it makes rapid, precise, learning of melodic lines, in real time it is possible to eliminate the player's need to learn appropriate notes, scales, and keys. Instead, the player can play "by ear," and position—making highly advanced playing easily accessible to beginners with minimal musical understanding.

18. Emulation of Super-Human Hand Configurations (Novel): 7-Finger, 11-Finger, etc., Up to 16 Fingers, 12 Slides Per Hand.

Since the present invention does not occupy a full finger to play it, utilizing the present invention (Triple Finger Slide for example) allows one to play music that would require more than the 4 fingers and a thumb.

19. Self-Picking.

The magnetic properties of the present invention allow the pulling-off of each note to accomplish a soft-plucking "pull-off" of the open-string note, obviating the need for the right hand to pick or pluck that open string note. As the magnetic slide contacts and release each string, the player has the option to pull-off more sharply and use the new string vibration generated an open note on the same string, thus eliminating the need to pluck the string with the right hand, or hammer on, to create another note. This increases speed and efficiency, as well as enhances playing ease.

20. Ability to Seamlessly Alternate Between Single-Note String Bending and Single-Note Slide Tones.

The present invention allows a player to overlay and alternate finger-generated string-bending techniques with slide techniques. Since finger-generating string-bending of notes is normally impossible while playing a traditional slide, this feature allows a player using the present invention to deliver a musical signature (string bending, rapidly alternating with slide-generated passages) which can suggest to the listener that more than one guitarist is playing at the same time, when in fact, this unusual dual-technique requires only one player using the present invention.

21. Super-High-Frequency Notes.

With a traditional slide one unique ability compared with finger players, is the ability of reaching "unplayable" notes, that is notes that are played on the string by placing the slide below the last fret and above the bridge. The present invention can accomplish this as well, while adding new layers of complexity such as: playing with fingers and transitioning into below-the-last fret zones, articulating further note and melodic Complexities Within that ultra-high frequency range and eliminating any seam between finger-playing and ultra-thigh frequency note playing as the player chooses to return to the fretted portion of the guitar, or play back-and-forth between the two regions (fretted and non-fretted).

22. Augmenting Chords.

The present invention enables a player to seamlessly add 4ths, 2nds, and other chord forms without lateral movements, slide rotation, or even using fingers. It is just necessary to press down across frets.

The present invention enables a broad range of new chord combinations to be created and played, while slide-playing, simply by adding an extra available finger, and/or angling one or more of the slide bars while playing. This creates a broad and novel vocabulary of new options for adding a touches of "color"—specific note intervals above the chord, such as 2nds, 3rds, 4ths, 5ths, 6ths, 7ths, 9ths, 11ths, 13ths, etc. to the sound of slide playing, which is either difficult, or impossible to do, without the present invention.

What is claimed is:

1. A system for use by a person to play a stringed instrument having a nut, comprising:

a magnetizing element which is placed near the one or more strings of the instrument above the nut;

said magnetizing element imparting a magnetic field to the one or more of the strings of the instrument;

at least one frequency selecting element comprising a more or less circular opening for placement upon the finger of said person;

said at least one frequency selecting element further comprising at least one magnetic element;

wherein said at least one magnetic element is positioned on the palm-side of the hand;

wherein said at least one frequency selecting element can be placed in contact anywhere along the length of said one or more strings which, if the one or more strings are caused to vibrate, limits the vibration of the one or more strings from the point of contact of the at least one frequency selecting element with the one or more strings.

2. A system for use by a person to play a stringed instrument having a nut, comprising:

at least one frequency selecting element comprising a more or less circular opening for placement upon a finger of said person;

said at least one frequency selecting element further comprising at least one magnetic element;

said at least one magnetic element positioned to be non-parallel with the finger when the frequency selecting element is being worn on a finger;

wherein said at least one magnetic element is positioned on the palm-side of the hand;

wherein said at least one frequency selecting element can be placed in contact with one or more of said strings, anywhere along the length of said one or more strings which, if said one or more strings are caused to vibrate, limits the vibration of said one or more strings from the point of contact of the at least one frequency selecting element with the one or more strings.

3. A system for use by a person to play a stringed instrument having a nut, comprising:

at least one frequency selecting element comprising a more or less circular opening for placement upon a finger of said person;

said at least one frequency selecting element further comprising at least one string-contacting element which is positioned to be non-parallel with the finger and positioned on the palm-side of the hand;

wherein said at least one frequency selecting element can be placed in one or more points of contact anywhere along the length of the one or more strings which, if the one or more strings is caused to vibrate, limits the vibration of the one or more strings from the one or more points of contact of the at least one frequency selecting element with said one or more strings.

4. A system, as described in claim 2, for use by a person to play a stringed instrument having a nut wherein said one or more magnetic elements has a shape selected from the group consisting of cylindrical bar, square bar, rectangular bars, curved bars and coin shaped.

5. A system as described in claim 3, for use by a person to play a stringed instrument having a nut wherein said at least one magnetic element has a shape selected from the group consisting of cylindrical bar, square bar, rectangular bars, curved bars and coin shaped.

6. A system as described in claim 4 for use by a person to play a stringed instrument having a nut wherein said at least one magnetic element has a beveled bar shape.

7. A system as described in claim 5 for use by a person to play a stringed instrument having a nut wherein said at least one magnetic element has a beveled bar shape.

* * * * *